US009250599B2

(12) United States Patent
Bradford et al.

(10) Patent No.: US 9,250,599 B2
(45) Date of Patent: Feb. 2, 2016

(54) AUTOMATIC TRAY SWITCHING FOR CONTINUED MARKING AFTER MEDIA TRAY MISFEED

(71) Applicant: XEROX CORPORATION, Norwalk, CT (US)

(72) Inventors: Richard Bradford, Hertfordshire (GB); Peter Granby, Hertfordshire (GB); Stephen Foster, Hertfordshire (GB); Wayne Rudge, Berkshire (GB); John A Kerslake, Hertfordshire (GB); Christopher D Olliffe, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/738,968

(22) Filed: Jun. 15, 2015

(65) Prior Publication Data

US 2015/0277335 A1 Oct. 1, 2015

Related U.S. Application Data

(63) Continuation-in-part of application No. 14/167,191, filed on Jan. 29, 2014, now abandoned.

(51) Int. Cl.

| | |
|---|---|
| ***G03G 15/00*** | (2006.01) |
| ***G03G 21/00*** | (2006.01) |
| ***B65H 3/44*** | (2006.01) |
| ***B65H 1/28*** | (2006.01) |
| ***B65H 7/20*** | (2006.01) |

(52) U.S. Cl.

CPC ..... *G03G 15/70* (2013.01); *B65H 1/28* (2013.01); *B65H 3/44* (2013.01); *B65H 7/20* (2013.01); *G03G 15/6508* (2013.01)

(58) Field of Classification Search

CPC ..... G03G 15/00; G03G 21/00; G03G 15/70; G03G 15/6508; B65H 3/44; B65H 7/28; B65H 7/20

See application file for complete search history.

(56) References Cited

U.S. PATENT DOCUMENTS

| | | | | |
|---|---|---|---|---|
| 4,008,957 | A * | 2/1977 | Summers | G03G 15/6508 271/9.11 |
| 4,231,567 | A | 11/1980 | Ziehm | |
| 4,881,104 | A * | 11/1989 | Kusumoto | G03G 15/6508 271/256 |
| 5,374,045 | A * | 12/1994 | Milillo | B65H 7/04 271/259 |
| 5,467,449 | A * | 11/1995 | Gauronski | H04N 1/32646 399/42 |
| 6,010,127 | A | 1/2000 | DiCesare et al. | |
| 7,896,344 | B2 | 3/2011 | Nakada et al. | |
| 2008/0205908 | A1 * | 8/2008 | Matsuura | G03G 15/502 399/8 |
| 2009/0285587 | A1 * | 11/2009 | Morita | G03G 15/6508 399/23 |
| 2010/0034550 | A1 * | 2/2010 | Arai | G03G 15/5016 399/81 |
| 2013/0272725 | A1 * | 10/2013 | Tanaka | G03G 15/70 399/21 |

FOREIGN PATENT DOCUMENTS

| | | | | |
|---|---|---|---|---|
| JP | 2001199577 A | * | 7/2001 | B65H 3/44 |
| JP | 2004175043 A | * | 6/2004 | G03G 15/00 |
| JP | 2004315220 A | * | 11/2004 | G03G 21/00 |

* cited by examiner

*Primary Examiner* — Nguyen Ha

(57) ABSTRACT

An auto tray switching method that is invoked when a misfeed occurs includes automatically switching to a different paper tray that has appropriate paper stock to continue a job. A misfeed signal is indicated only if the tray in which the misfeed occurred is selected by a user for another job.

17 Claims, 1 Drawing Sheet

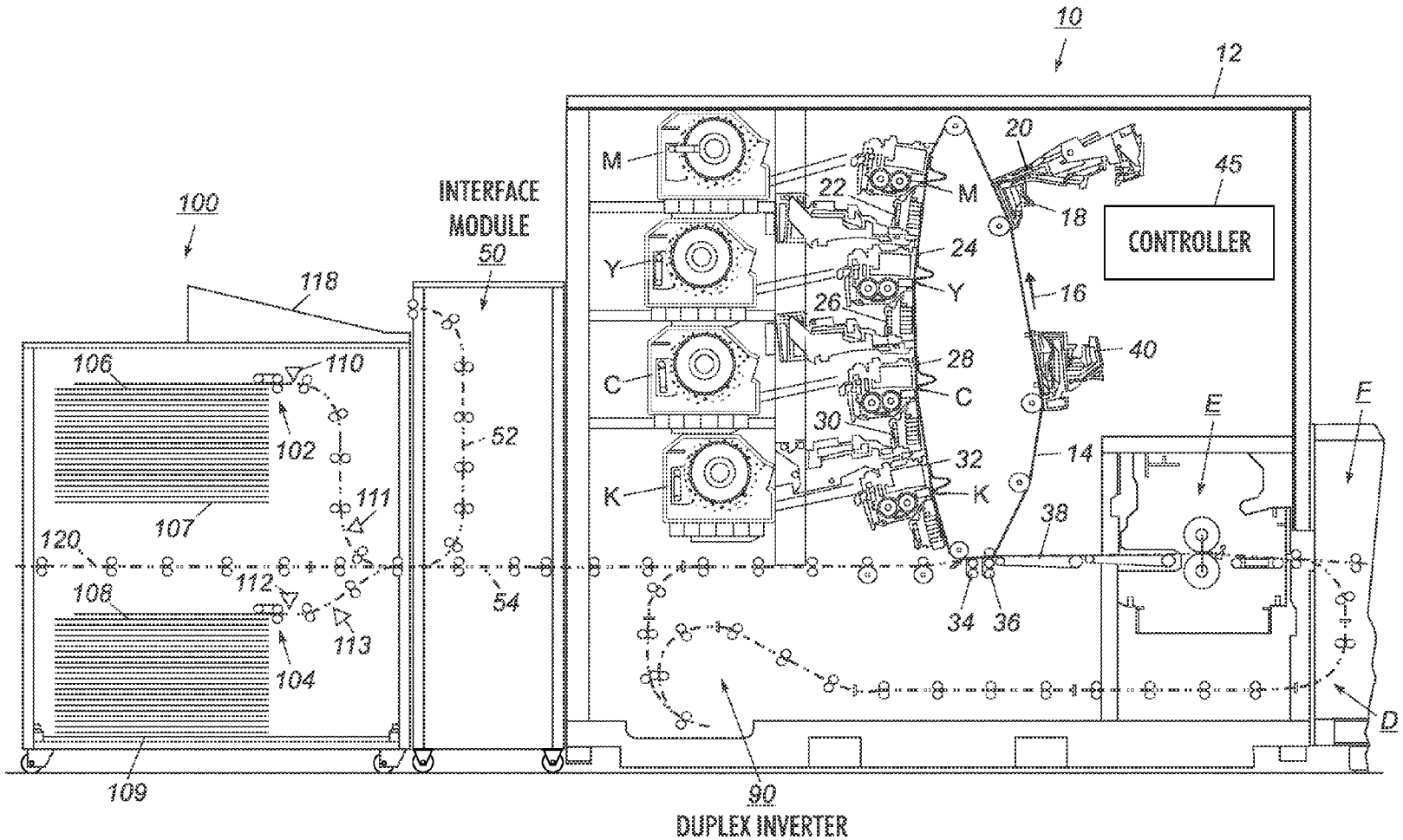
CONTROLLER
DUPLEX INVERTER
INTERFACE MODULE 50
10
12
14
16
18
20
22
24
26
28
30
32
34
36
38
40
45
52
54
90
100
102
104
106
107
108
109
110
111
112
113
118
120
M
Y
C
K
E
D

AUTOMATIC TRAY SWITCHING FOR CONTINUED MARKING AFTER MEDIA TRAY MISFEED

CROSS-REFERENCE TO RELATED APPLICATIONS

This disclosure is a continuation-in-part of co-pending U.S. patent application Ser. No. 14/167,191, entitled AUTOMATIC TRAY SWITCHING FOR CONTINUED MARKING AFTER MEDIA TRAY MISFEED, filed Jan. 29, 2014 by the same inventors, and claims priority therefrom.

BACKGROUND

1. Field of the Disclosure

The present disclosure relates to printing machines that include multiple media feeders/trays, and more particularly, to a method for automatically switching to another of said multiple media trays when a misfeed from a selected media tray is detected.

2. Description of Related Art

Currently, when a misfeed occurs, the marking engine immediately shuts down and the user is requested to check the paper in the paper feed tray or purges paper upstream of the jam and then shuts down. Marking is stopped and the job is paused until the user follows given instructions. This can be frustrating for users magnifying the impact of the misfeed, especially if they have submitted a large job and have waited a while before going to the machine expecting to just pick up their prints.

Heretofore, various jam clearing methods have been employed. For example, U.S. Pat. No. 7,896,344 shows a marking machine that includes a system that automatically clears itself of jams in the machine when the machine is unattended. The paper transport is enabled to move forward and backward and when a jam occurs it will automatically move backward until the jam is cleared. In U.S. Pat. No. 4,231,567 a method and apparatus for clearing jams in the transport path of a copier includes the steps of sensing a jam, clustering in process sheets at the jam or at a location upstream of the jam location, while simultaneously allowing the sheets downstream of the jam location to continue. In U.S. Pat. No. 6,010,127 a buckle chamber is provided along a sheet path where jammed sheets are compiled during a down cycle during a jam.

Unfortunately, even though the jam clearance techniques of the above prior art are useful, the misfeed problems of virgin sheet input feeders mentioned-hereinabove are still present.

BRIEF SUMMARY

In answer thereto, provided hereinafter is an auto tray switching method that is invoked when a misfeed occurs if another paper tray that has appropriate paper stock that can be used to continue the job is available. This keeps the job marking and at the end of the job the user is then directed to check the paper feed tray. Other jobs could also be allowed to mark even after the misfeed but before it is cleared if other paper trays can be used. This significantly decreases the impact of the misfeed on the user and the frustration of the job being paused. Additionally, notification of a jam would only be triggered by a user selecting use of the specific tray in which the jam occurred.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some such components are known per se' in other apparatus or applications, which may be additionally or alternatively used herein, including those from art cited herein. The cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

FIG. 1 is a partial, frontal view of an exemplary modular xerographic printer that includes the improved automatic feed tray switching method and apparatus of the present disclosure.

Referring now to printer 10 in FIG. 1, as in other xerographic machines, and as is well known, an electrographic printing system is shown including the improved method and apparatus for automatic feed tray switching from a paper feed tray embodiment of the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, et., which performs a print outputting function for any purpose. Marking module 12 includes a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 through interface module 50 and brings the copy sheets into contact with the image on belt 14. Sheet feeder module 100 includes high capacity feeders 102 and 104 that feed sheets from sheet stacks 106 and 108 positioned on media supply trays 107 and 109 into interface module 50 that directs them either to purge tray 118 through sheet feed path 52 or to imaging or marking module 12 through sheet feed path 54. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

With further reference to FIG. 1, and in accordance with the present disclosure, printer software through controller 45 facilitates a productivity and convenience improvement for operators by allowing the printing of a single or multiple jobs without operator intervention even though a misfeed may occur in a selected media feeder. In practice, if a misfeed occurs in a sheet feeder that is feeding sheets for imaging, controller 45 immediately signals another feed tray to begin feeding of sheets of the same stock to continue the job since a paper tray misfeed would not usually block the paper path and stop other trays from feeding sheets through the paper path. Sensor 110 would sense a misfeed of media from stack 106 positioned on feed tray 107 by high capacity feeder 102 and sensor 111 will sense a media jam in media fed from feed tray 107. This keeps the job marking and at the end of the job the user can walk away or continue with additional jobs as long as the originally selected tray is not designated as the feed tray. If the original tray that contains the misfeed is selected by a user as the feed tray before the misfeed has been cleared, controller 45 will display a paper misfeed screen and the user is then directed to check the selected paper feed tray. The same is true for a misfeed or jam of media feed from feed tray 109 as a selected feed tray. That is, sensor 112 would sense a misfeed of media from stack 108 positioned on feed tray 109 by high capacity feeder 104 and sensor 113 will sense a media jam in media fed from feed tray 109. It should be understood that other jobs are allowed to mark even after the misfeed but before if it is cleared when other trays with appropriate media are available. Thus, the impact of a misfeed or jam on the user is negligible.

For example, for two back to back jobs for which tray 107 has been selected and tray 109 also has the same media loaded, then if a misfeed occurs in tray 107 job 1 would be printed out of tray 109 and then job 2 would be printed out with tray 109 being used as the substitute. Additional users could also use the printer with tray 109 being the default paper tray. Computer 45 would only raise a paper jam screen if the user tries to print a new job specifically asking for tray 107. This approach remembers the paper jam but with all jobs marking around the affected paper tray only when a user tries to directly select paper tray 107 is the jam issue addressed. So, for example, if there were print jobs requesting tray 107 and tray 107 was jammed then those jobs will be printed out. It would only be the walk up user who could trigger these paper jam screens.

In recapitulation, a method is disclosed by which paper tray misfeeds or paper jams which occur early in the paper path and not impacting the printing from other paper trays would not stop a print job from continuing when the same size paper is available in an alternative tray. This automatic switching of paper trays would allow for a print job to be completed and would still result in notification of the misfeed or paper jam condition under predetermined conditions.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for ensuring completion of an initial print job of multiple print jobs when a misfeed occurs in feeding from a tray, including:

providing multiple trays with similar media therein;

selecting one of said multiple trays for a print job;

providing a feed head and initiating feeding of media from said selected one of said multiple trays into a predetermined paper path;

providing a marking unit for marking on said media;

automatically switching from said selected tray to another of said multiple trays when a misfeed occurs in feeding from said selected one of said multiple trays to thereby continue marking on said media and completing said initial print job;

allowing other different print jobs of said multiple print jobs to continue marking after said initial job has been completed without interruption after said misfeed has occurred and before said misfeed has been cleared; and printing new jobs while said misfeed remains in place, and providing a controller having a paper jam screen, and wherein said paper jam screen in raised only if a user attempts a new job that requires use of said selected tray.

2. The method of claim 1, including causing said automatic switching from said selected one of said multiple trays to the other of said multiple trays when a misfeed occurs downstream of said selected one of said multiple trays when feeding from said other of said multiple trays would not be impacted by said jam.

3. The method of claim 1, including providing notification to a user of the misfeed condition.

4. The method of claim 2, including providing notification to a user of the misfeed condition.

5. The method of claim 1, wherein said media in said multiple trays are identical.

6. The method of claim 5, wherein said multiple trays includes at least two trays.

7. The method of claim 6, wherein said feed head comprises a friction retard feeder.

8. The method of claim 7, wherein said media is fed to a photoreceptor belt.

9. The method of claim 1, wherein said feed head is incorporated into a xerographic device.

10. A reprographic device includes a method for improving productivity when feeding sheets representing multiple print jobs from a selected tray for processing within said reprographic device without operator intervention, including:

loading similarly sized stacks of sheets into at least first and second trays;

providing a feed head and initiating feeding of sheets from said first tray into a predetermined paper path;

providing a first sensor for sensing a feed head misfeed from said first tray;

automatically switching feeding from said first tray to said second tray when a misfeed is sensed by said first sensor in a first of said multiple print jobs in order to continue said first of said multiple print jobs without interruption; and providing said reprographic device with a paper misfeed screen, and wherein said paper misfeed screen is raised only if a user tries to select a new job that requires use of said first tray.

11. The reprographic device of claim 10, including providing a second sensor for sensing sheet jams occurring within said predetermined paper path.

12. The reprographic device of claim 10, including providing notification to a user of the misfeed condition.

13. The reprographic device of claim 10, wherein said stacks of sheets in said plurality of trays are identical in size and composition.

14. The reprographic device of claim 13, wherein said plurality of trays includes at least two trays.

15. The reprographic device of claim 14, wherein said feed head comprises a friction retard feeder.

16. The reprographic device of claim 15, wherein said sheets are fed to a photoreceptor belt to receive marks thereon.

17. A method for ensuring completion of multiple jobs without interruption when a jam occurs within a predetermined distance of feeding sheets from one of multiple trays into a predetermined paper path for a first of said multiple jobs, including:

providing said multiple trays with similar sheets therein;

selecting one of said multiple trays for a first of said multiple jobs;

providing a feed head and initiating feeding of sheets from said selected one of said multiple trays into said predetermined paper path;

automatically switching from said selected tray to another of said multiple trays when a jam occurs within a predetermined distance from said feed head; and providing a paper jam screen whose raising is triggered only if a user tries to accomplish a new job that requires use of said selected tray.

* * * * *